United States Patent [19]

Bronfenbrenner et al.

[11] Patent Number: 4,536,275

[45] Date of Patent: Aug. 20, 1985

[54] INTEGRATED TWO-STAGE COAL LIQUEFACTION PROCESS

[75] Inventors: James C. Bronfenbrenner; Ronald W. Skinner, both of Allentown, Pa.; Samuel Znaimer, Vancouver, Canada

[73] Assignee: International Coal Refining Company, Allentown, Pa.

[21] Appl. No.: 586,937

[22] Filed: Mar. 7, 1984

[51] Int. Cl.[3] ..... C10G 1/06; C10G 1/00

[52] U.S. Cl. ..... 208/10; 208/8 LE

[58] Field of Search ..... 208/8 LE, 10

[56] References Cited

U.S. PATENT DOCUMENTS

| | | | |
|---|---|---|---|
| 4,070,268 | 1/1978 | Davis et al. | 208/8 LE X |
| 4,085,031 | 4/1978 | Walchuk | 208/8 LE |
| 4,094,766 | 6/1978 | Gorin | 208/8 LE X |
| 4,111,788 | 9/1978 | Chervenak et al. | 208/10 |
| 4,119,523 | 10/1978 | Baldwin et al. | 208/8 LE X |
| 4,164,466 | 8/1979 | Baldwin et al. | 208/8 LE X |
| 4,189,372 | 2/1980 | Baldwin et al. | 208/8 LE |
| 4,251,346 | 2/1981 | Dry et al. | 208/10 |
| 4,255,248 | 3/1981 | Rosenthal et al. | 208/10 X |
| 4,298,451 | 11/1981 | Neuworth | 208/8 LE |
| 4,338,182 | 7/1982 | Vernon et al. | 208/8 LE |
| 4,347,117 | 8/1982 | Bauman et al. | 208/8 LE |
| 4,372,838 | 2/1983 | Kulik et al. | 208/10 |
| 4,400,263 | 8/1983 | Kydd et al. | 208/10 |
| 4,461,694 | 7/1984 | Givens et al. | 208/8 LE |

*Primary Examiner*—D. E. Gantz

*Assistant Examiner*—William G. Wright

[57] ABSTRACT

This invention relates to an improved two-stage process for the production of liquid carbonaceous fuels and solvents from carbonaceous solid fuels, especially coal.

7 Claims, 2 Drawing Figures

DISTILLATE YIELD VS TIME AND TEMPERATURE

TRIANGLE: 840°F, CIRCLE: 810/800°F, SQUARE: 780/760°F
SOLID: HSRC, OPEN: LSRC, DOUBLE = NORMAL SOLVENT

INTEGRATED TWO-STAGE COAL LIQUEFACTION PROCESS

The Government of the United States of America has rights in this invention pursuant to contract No. DE-AC05-780R03054 (as modified), awarded by the U.S. Department of Energy.

BACKGROUND OF THE INVENTION

This invention relates to a process for the liquefaction of carbonaceous solid fuels, particularly coals enhanced with respect to production of liquid carbonaceous fuels and solvents.

Many processes have been proposed for the production of low-sulfur, low-ash, carbonaceous fuels and distillate hydrocarbon fuels by solvent refining of coal in the presence of a hydrogen donor solvent. Typically, such a process includes the heating and liquefaction of the coal yielding light gases and a slurry which is further processed by vacuum distillation to produce a light distillate product, a recycle solvent, and a heavy fraction, including residual solvent, dissolved coal products, undissolved coal, minerals or ash materials, and unconverted coal macerals.

It is well known that further products may be produced by subjecting the vacuum still bottoms to a solvent deashing process which is sometimes referred to as "critical solvent deashing." Such a process is disclosed in U.S. Pat. No. 4,070,268. As indicated in that patent, the products of the critical solvent deashing process include a stream (HSRC) which is rich in coal products soluble in pyridine, but which is essentially free of ash and unconverted particulate coal. A bottom stream is also produced which includes insoluble coal products and ash. Finally, an underflow stream of LSRC rich in products soluble in benzene or toluene is produced which is either recycled as solvent in the SRC process or removed as a product.

As shown by U.S. Pat. No. 4,164,466, the solvent deashing stage often comprises several separation zones, each maintained at successively higher temperatures and at high pressure. This patent also discloses a process wherein the underflow stream of the second zone in the deashing stage is recycled to the entry mixing zone in the deashing stage.

In the process disclosed in U.S. Pat. No. 4,189,372, a portion of the underflow from the third and fourth separators is hydrogenated and recycled to the coal liquefaction slurry tank. Substantially all other intermediate streams from the second through the fourth separators are recycled to the entry mixing zone of the SRC process stage as in the U.S. Pat. No. 4,164,466.

In U.S. Pat. No. 4,119,523, the underflow from the first separator in the solvent deashing stage is extracted to separate the resulting ash and undissolved coal, and the remaining extract recycled to the coal liquefaction stage.

U.S. Pat. No. 4,298,451 teaches the catalytic hydrocracking of a clean coal extract 500° F.+ (260° C.+). The process disclosed uses a catalytic ebullated bed hydrocracker maintained at a temperature of 750°–825° F. (399°–441° C.) and a hydrogen pressure of 2000–3000 psi (13793–20689 Kpa). The preferred catalyst is NiMo.

U.S. Pat. No. 4,111,788 teaches the hydrogenation of the total effluent of a non-catalytic first stage reaction in an ebullated bed catalytic reaction zone which consists of two reactors. The first reactor may comprise an ebullated bed of non-catalytic material while the second zone is an ebullated bed of catalyst.

U.S. Pat. No. 4,255,248 discloses a two-stage process for the catalytic hydrocracking of coal in which the first stage comprises a catalytic reactor operating under hydrocracking conditions.

In view of this prior art there remains a need for further varieties of products and enhancements to an integrated two-stage coal liquefaction process.

It is, therefore, the general object of the present invention to provide such products and improved processes.

BRIEF DESCRIPTION OF THE INVENTION

The present invention involves a solvent coal refining process in which, following liquefaction and light gas separation, the coal slurry is subjected to vacuum distillation, the bottom stream of which is solvent deashed. This solvent deashing includes a sequence of separation steps at elevated temperature and pressure.

Solvent and the "Light SRC" and "Heavy SRC" are hydrocracked on a second stage catalyst bed to yield commercially useful liquid fuels, solvents, and gases. The present invention involves an improvement in the process wherein substantially all the 500° F.+ hydrocracker flash bottoms are recycled as first stage dissolver solvent, and the hydrocracker solvent is substantially comprised of 500° F. to EP distillate from the first state fractionator.

The term "Light SRC" or "LSRC" refers to and defines that SRC material which is comprised of approximately one-third ($\frac{1}{3}$) oils, which are pentane-soluble, and two-thirds ($\frac{2}{3}$) asphaltenes, which are pentane insoluble, benzene soluble. LSRC has a softening point of about 180° F. (82.2° C.).

The term "Heavy SRC" or "HSRC" refers to and defines that SRC material which is comprised of approximately equal amounts of asphaltenes which are pentane insoluble, benzene soluble and preasphaltenes which are benzene insoluble, pyridine soluble with only a trace amount (about 1%) soluble in pentane. HSRC has a softening point of about 380° F. (193.3° C.).

In the present invention, coal, recycle solvent, and hydrogen are mixed, preheated, and reacted in a first stage dissolver vessel of a type which is well-known in the coal liquefaction art. The dissolver effluent, comprising a mixture of hydrogen, water vapor, light hydrocarbon gases, light oil, solvent, solvent refined coal (SRC), insoluble carbon, and ash, is sent to a high-pressure, high-temperature separator to remove most or all of the vapor-phase material for recovery as recycle hydrogen and condensate products.

The underflow from the separator is directed to a distillation system for recovery of the process solvent and then to a critical solvent deashing system for separation of oils and asphaltenes from solids and preasphaltenes. The residue stream consisting of unconverted coal, minerals, and preasphaltenes is sent to a gasifier system. The Heavy SRC product is partially removed as product and partially combined with the Light SRC and directed to an ebullated bed hydrocracker and then to a separator which allows recovery of process solvents, products, and gases.

DETAILED DESCRIPTION OF THE INVENTION

Figure 1:
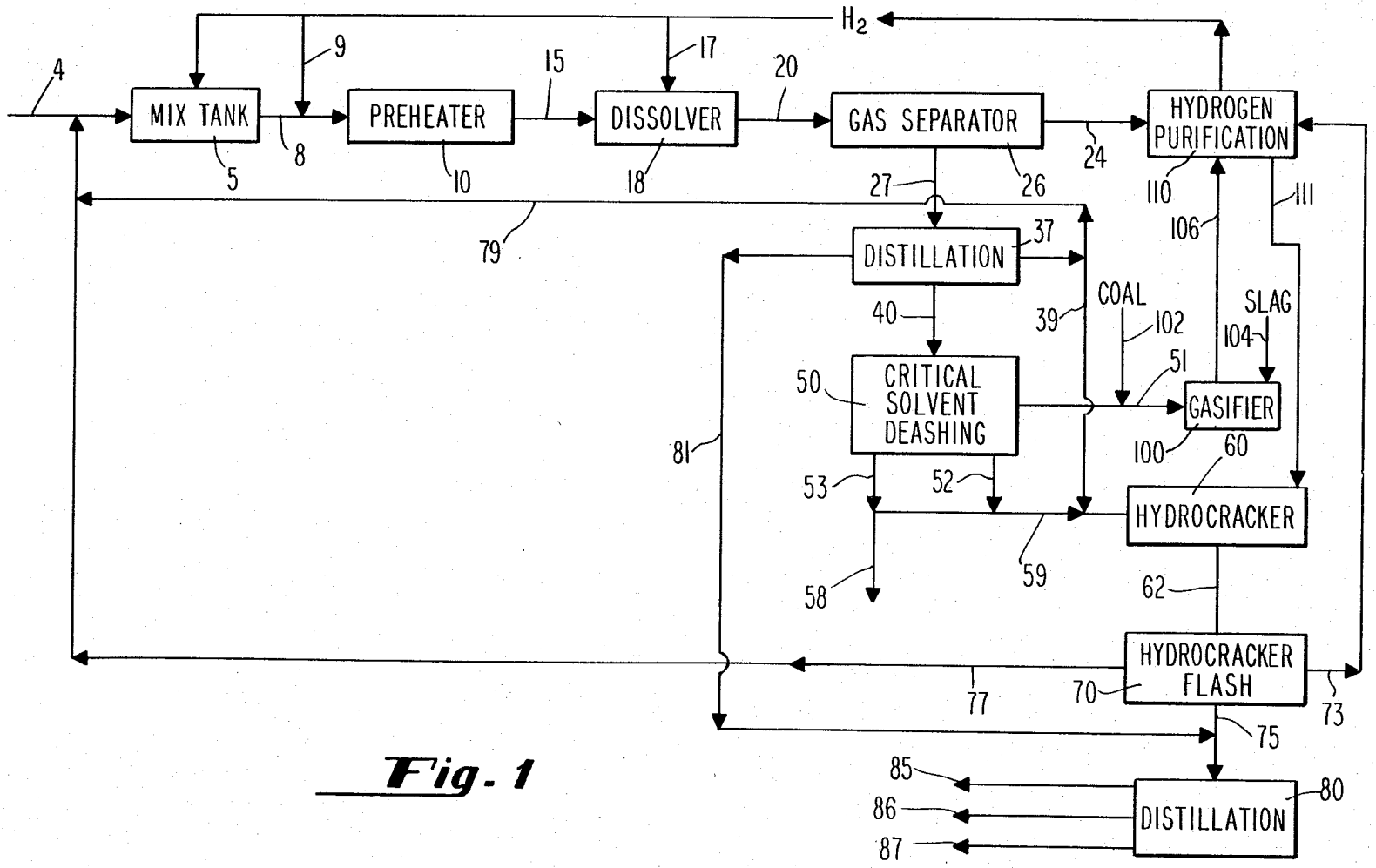
FIG. 1 is a schematic flow diagram of a coal liquefaction process with a fixed bed hydrocracker stage which is the process improvement of the present invention.

For a better understanding of the present invention, reference may be made to the detailed description which follows, taken in conjunction with the accompanying Figures and the claims.

Feed coal 4, SRC solvent 79, and approximately 500° F.+ hydrocracker flash bottoms 77 are combined to form a slurry in mix tank 5 at temperatures from 250° F. to 450° F. (232° C.) in ratio of from 2:0:1 to 0.2:1.5:1.0 hydrocracker flash bottoms to SRC solvent to MF coal.

The slurry is then passed via line 8 to preheater 10, where it is heated at a pressure of from 500 to 3000 psig (3448 to 20690 Kpa) to a temperature of from 600° to 850° F. (316° to 454° C.). Hydrogen-rich gas is mixed with the slurry prior to its introduction into the preheater via feed line 9.

The heated and pressurized slurry is then passed via line 15 to dissolver 18, which may consist of one or more reactor vessels operated in series or in parallel. Hydrogen-rich gas may be added to the dissolver via line 17 if desired.

The superficial flow through dissolver 18 is generally from 0.003 to 0.1 feet per second for the gas phase. These rates are selected to ensure adequate mixing in the reactor. Hydrogen feed rates are maintained at 10–40K SCF/TON coal. Residence time in dissolver 18 is greater than 40 minutes.

The effluent from dissolver 18 is passed to a gas separation system 26 via line 20. Light gases including hydrogen $H_2S$, $CO_2$, $NH_3$, $H_2O$, and $C_1$–$C_4$ hydrocarbons are removed via line 24, to hydrogen purification system 110. The underflow from gas separator 26 is passed via transfer line 27 to distillation system 37.

Distillation system 37 yields four effluent streams 79, 81, 39, and 40. Stream 81 is composed of 400° F.− material (204° C.−). Effluent streams 39 and 79 are composed of 400° to 850° F. material (204° to 454° C.). Effluent stream 40 contains SRC bottoms which consist primarily of 850° F.+ material (454° C.+) including SRC, unconverted coal, and ash. Stream 40 is routed to critical solvent deashing system 50 for subsequent processing. Stream 79 is recycled to the mix tank 5 as solvent.

The critical solvent deashing process is described in U.S. Pat. No. 4,119,523. Critical solvent deashing unit 50 yields an ash concentrate stream 51 which is removed from the system and may be passed to equipment for hydrogen generation, preferably a gasifier 100.

Critical solvent deashing unit 50 also yields effluent streams 52 and 53. Effluent stream 52 consists of Light SRC and is directed to hydrocracker 60 via line 59. Effluent stream 53 consists of Heavy SRC and is partially directed to hydrocracker 60 via line 59 and partially removed as product via line 58. Distillation system effluent 39 is also sent to hydrocracker 60 via line 59, comprising less than 50% of the hydrocracker feed.

Hydrocracker 60 is operated as an ebullated catalyst bed at 1500° to 3500 psig (10345 to 24139 Kpa) at 700° to 850° F. (371° to 454° C.). The effluent stream from hydrocracker 60 is sent via line 62 to hydrocracker flash unit 70 where recycle hydrogen and other light gases are transferred via line 73 to hydrogen purification system 110. The liquid product is flashed to separate streams boiling above and below 500° F. (260° C.), substantially all of the former being directed via line 77 to the first stage of the process where it serves as process solvent. The 500° F.− stream (260° C.−) is combined with the light distillate stream 81 and sent via line 75 to distillation system 80.

Distillation system 80 produces three product streams 85, 86, and 87. Streams 85, 86, and 87 are typically a 350° F.− stream (177° C.−), a 350° to 450° F. stream (177° to 232° C.), and a 450°+ stream (232° C.+) or any combination thereof.

The following example is an illustration of the integrated two-stage liquefaction process of this invention:

Illinois No. 6 coal is slurried with hydrocracker flash bottoms and first stage distillation system effluent, pressurized, and pumped through the liquefaction reactor. The liquefaction effluent is flashed to remove light gases which are subsequently scrubbed to remove acidic and alkaline components. Hydrogen and lower hydrocarbons are recovered and recycled after purification to various process stages. Alternatively, these gases may be burned for fuel. The flash bottoms are then distilled at atmospheric and subatmospheric pressure. A portion of the distillation overhead is recovered as net product while the rest of such distillation overhead is used as solvent for the hydrocracker stage.

Vacuum tower bottoms are routed to a Kerr-McGee critical solvent deashing unit which characteristically rejects the highest molecular weight refractory preasphaltenes along with unconverted coal and ash. Portions of the HSRC and LSRC products of the critical solvent deashing unit are blended together, mixed with process solvent, pressurized, and preheated before being sent to the hydrocracker. The products from the hydrocracking reactor are flashed to recover recycle hydrogen and gases which are fractionated and purified in the same manner as for the first stage. Liquid product from the flash stage is flashed again to separate streams boiling nominally above 500° F. and below 500° F. The 500° F.− stream is collected as product while the 500° F.+ stream is recycled to the first stage to be used as process solvent.

Table I details the process conditions for the calculated example. Table II details the yield structure for the calculated example.

TABLE I

| | PDU Process Conditions | Commercial Range |
|---|---|---|
| SRC Unit | | |
| Coal (MF):1st stage distillate solvent: Hydrocraker flash bottoms, wt. ratio | 1:1.1:.55 | 1:1.5:0.2 to 1:0.0:2 |
| Slurry concentration, wt. % MF coal | 37.8 | 35–40 |
| Feed gas, scf/lb MF coal | 20 | 15–30 |
| Hydrogen purity, mol % | 100 | 80–100 |
| Reactor nominal residence time, min | 60 | 30–120 |
| Reactor pressure, psig | 2000 | 1500–2500 |
| Hydrogen partial pressure, inlet psia | 2000 | 1000–2000 |
| Reactor temperature, outlet °F. | 810 | 750–840 |
| HTR Unit | | |
| Feed slurry concentration, wt. % SRC | 70.0 | 50–80 |
| Space velocity (lb feed/hr) lb cat | 0.25 | 0.1–4.0 |
| Recycle gas rate, SCF/lb SRC | 30 | 20–40 |
| Hydrogen purity, mol % | 100 | 80–100 |
| Hydrogen partial pressure, inlet psia | 2000 | 2000–2500 |
| Temperature, °F. | 805 | 700–840 |

TABLE II

| Yield Structure | |
|---|---|
| Yields, wt. % MAF Coal | |
| Hydrogen consumption | (3.9) |
| Total gases | |
| $C_1/C_4$ | 13.7 |
| $H_2S$ | 2.5 |
| $CO_x$ | 1.6 |
| $NH_3$ | 0.6 |
| $H_2O$ | 6.3 |
| Net Usable Product | |
| IBP-400° F. | 16.2 |
| 400-500° F. | 8.4 |
| 500-650° F. | 9.1 |

TABLE II-continued

| Yield Structure | |
|---|---|
| 650-EP | 12.4 |
| CSD SRC | 11.9 |
| Ash Concentrate | |
| SRC | 14.6 |
| Unconverted coal | 6.6 |
| Total | 100.0 |

A necessary feature of the process integration scheme of the present invention is that the process solvent for the first stage includes substantially all of the 500° F.+ hydrocracker flash bottoms. These hydrocracker flash bottoms are rich in asphaltenes and preasphaltenes and provide a substantially improved solvent quality as compared to the prior art. Comparative solvent qualities are illustrated in Table III.

TABLE 3

Summary of Yield Distribution Data for Kentucky #9 Mulford Coal

| Temperature, (°F.) | 800 | 800 | 800 | 800 | 840 | 840 | 840 | 760 | 810 | 810 | 810 | 840 | 840 | 840 | 700 |
|---|---|---|---|---|---|---|---|---|---|---|---|---|---|---|---|
| Residence Time (min)* | 20 | 20 + 20 | 30 + 30 | 40 + 40 | 20 | 20 + 20 | 30 + 30 | 30 + 30 | 20 | 40 | 30 + 30 | 20 | 20 + 20 | 30 + 30 | 30 + 30 |
| Solvent | ARS | ARS | ARS | ARS | ARS | ARS | ARS | ARS | BASE | BASE | BASE | BASE | BASE | BASE | BASE |
| Conversion (% MAF Coal) | 87.5 | 91.3 | 91.4 | 93.6 | 78.2 | 80.1 | 81.9 | 92.0 | 88.4 | 89.6 | 91.8 | 88.0 | 89.5 | 88.2 | 91.5 |
| $H_2$ Consumption | 1.4 | 2.1 | 2.9 | 3.1 | 2.0 | 3.4 | 4.1 | 2.0 | 1.5 | 2.0 | 2.4 | 1.5 | 2.6 | 3.1 | 2.1 |
| Yields | | | | | | | | | | | | | | | |
| $C_1$-$C_4$ | 4.9 | 8.5 | 9.1 | 10.2 | 10.3 | 16.2 | 19.1 | 3.2 | 4.4 | 7.2 | 9.3 | 6.3 | 12.3 | 14.9 | 4.9 |
| $CO + CO_2$ | 1.4 | 1.9 | 1.7 | 1.6 | 1.8 | 2.3 | 2.2 | 1.4 | 1.5 | 1.8 | 2.0 | 1.6 | 1.7 | 2.2 | 0.5 |
| $H_2S + NH_3$ | 1.2 | 1.7 | 1.7 | 1.5 | 1.5 | 2.1 | 2.0 | 1.3 | 1.6 | 2.0 | 2.3 | 1.4 | 2.8 | 2.7 | 1.0 |
| $H_2O$ | 2.9 | 3.1 | 5.0 | 4.7 | 4.5 | 5.0 | 5.9 | 3.8 | 3.2 | 3.6 | 3.0 | 2.2 | 4.0 | 4.9 | 4.4 |
| Distillate | 12.3 | 23.9 | 33.7 | 39.1 | 12.5 | 16.8 | 25.4 | 28.5 | 17.9 | 20.0 | 26.9 | 15.5 | 20.2 | 22.6 | 25.0 |
| SRC | 64.2 | 54.7 | 42.7 | 39.7 | 49.3 | 39.0 | 29.5 | 55.8 | 58.4 | 53.1 | 48.9 | 60.3 | 49.0 | 40.9 | 54.5 |
| Asphaltene | 16.2 | 21.0 | 19.1 | 18.2 | 18.8 | 11.8 | 8.7 | 27.1 | 31.0 | 29.1 | 25.3 | 31.0 | 24.6 | 23.0 | 31.2 |
| Preasphaltene | 48.0 | 33.7 | 23.5 | 21.5 | 30.5 | 27.2 | 20.8 | 28.7 | 27.4 | 24.0 | 23.7 | 29.2 | 24.4 | 18.0 | 23.3 |

| Temperature, (°F.) | 800 | 840 | 760 | 800 | 840 | 760 | 800 | 840 | 760 | 800 | 840 |
|---|---|---|---|---|---|---|---|---|---|---|---|
| Time (min.) | 20 | 20 | 20 + 20 | 20 + 20 | 20 + 20 | 30 + 30 | 30 + 30 | 30 + 30 | 70 + 70 | 70 + 70 | 70 + 70 |
| Solvent | PRS | PRS | PRS | PRS | PRS | PRS | PRS | PRS | PRS | PRS | PRS |
| Distillate | 35.9 | 35.1 | 29.0 | 42.7 | 44.3 | 33.8 | 47.5 | 51.6 | 46.9 | 62.4 | 57.0 |
| SRC | 41.9 | 37.8 | 53.6 | 35.0 | 23.1 | 45.4 | 28.8 | 13.2 | 32.3 | 10.8 | 7.2 |
| Asphaltene | 15.1 | 11.09 | 20.4 | 15.3 | 10.9 | 21.4 | 16.0 | 8.1 | 22.5 | 6.4 | 7.4 |
| Preasphaltene | 26.8 | 25.9 | 33.2 | 19.7 | 12.2 | 24.0 | 12.8 | 5.1 | 9.8 | 4.3 | −0.3 |
| HC Gases | 3.0 | 6.3 | 2.1 | 6.0 | 12.5 | 3.5 | 7.0 | 16.3 | 4.7 | 10.8 | 20.5 |
| $CO + CO_2$ | 1.5 | 2.0 | 1.3 | 2.1 | 2.5 | 1.6 | 2.1 | 2.7 | 1.5 | 2.1 | 2.1 |
| $H_2S + NH_3$ | 1.6 | 1.8 | 1.4 | 2.1 | 2.5 | 1.6 | 1.5 | 2.6 | 1.9 | 2.6 | 2.5 |
| $H_2O$ | 3.5 | 4.9 | 3.0 | 3.8 | 5.7 | 5.2 | 5.7 | 6.0 | 5.5 | 6.7 | 6.1 |
| Coal Conversion | 86.2 | 86.5 | 89.2 | 89.7 | 87.9 | 89.2 | 90.1 | 88.9 | 90.5 | 91.8 | 90.2 |
| $H_2$ Consumption | 1.4 | 1.7 | 1.4 | 2.3 | 3.0 | 1..7 | 2.6 | 4.0 | 2.4 | 3.3 | 5.6 |

*Addition of two numbers indicates two reactors in series.

An asphaltene rich solvent (ARS) is defined as a non-integrated SRC-I process solvent to which 30 wt% LSRC gas been added. A presaphaltene rich solvent (PRS) is defined as the non-integrated SRC-I process solvent to which 30% HSRC has been added. The compositions of the non-integrated base solvent, ARS and PRS, are illustrated in Table IV.

TABLE IV

| Solvent Composition, wt. % | Base | ARS | PRS |
|---|---|---|---|
| Oils | 96 | 85 | 74 |
| Asphaltenes | 4 | 13 | 16 |
| Preasphaltenes | 0 | 2 | 10 |

Figure 2:
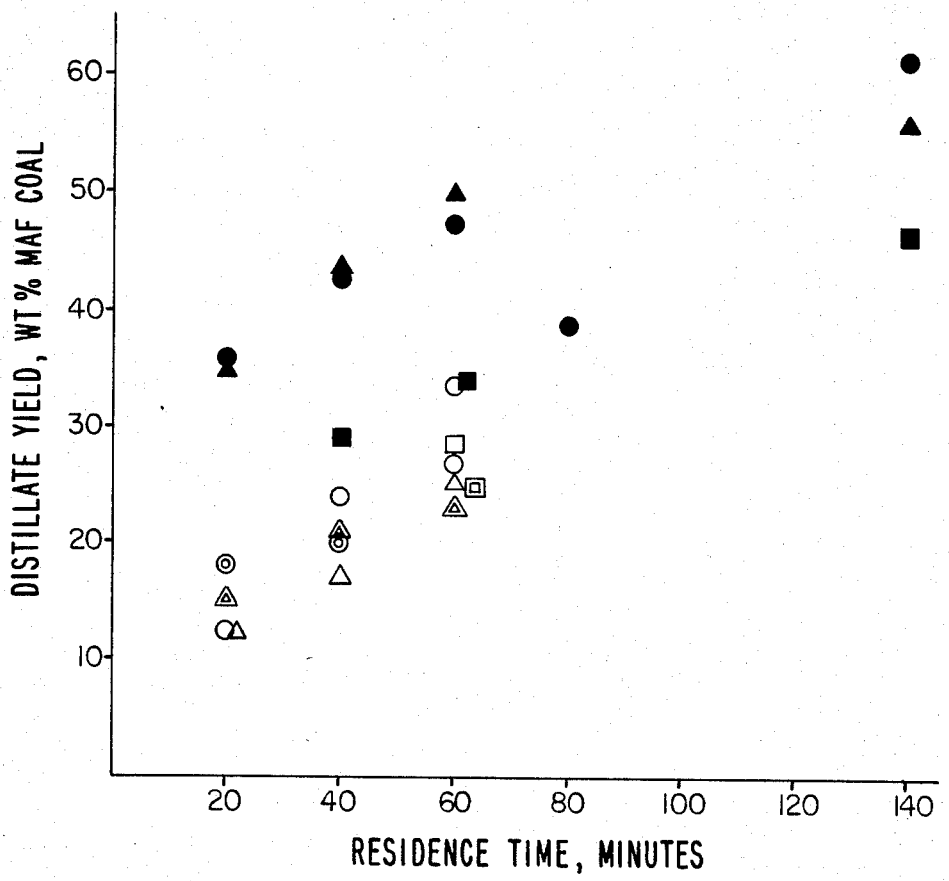
FIG. 2 is a graph depicting yields for a variety of process solvents.

In each case, Kentucky No. 9 Mulford coal was slurried with each solvent and reacted at a range of dissolver operating conditions. These conditions and the product yields achieved for each are reported in Table III. The yields are graphically represented as FIG. 2. Clearly, FIG. 2 demonstrates that recycle of asphaltenes and preasphaltenes to the dissolver stage improves distillate yield substantially.

Several important facets of the integrated two stage liquefaction process of this invention are demonstrated by the results achieved in Wilsonville Run No. 242 which was reported in "Technical Progress Report Run 242, with Illinois #6 Coal," DOE/PC/50041-19.

Illinois No. 6 coal was slurried with hydrotreated flash bottoms, pressurized, and pumped through the liquefaction reactor. The liquefaction effluent was flashed to remove light gases which were scrubbed to remove acidic and alkaline components. The hydrogen and lighter hydrocarbons were recovered and recycled to various process stages or burned for fuel. The flash bottoms were then distilled at atmospheric and reduced pressure. Some of the distillation overhead was recovered as net product while the rest was used as solvent in the hydrocracker. The vacuum tower bottoms were routed to the Kerr-McGee critical solvent deashing unit where ash and unconverted coal were removed. The HSRC and LSRC products of the CSD were blended, mixed with process solvent from the SRC unit, pressurized, and preheated before being sent to the ebullated bed hydrocracker. The products from the hydrocracking reactor were flashed to recover recycle hydrogen and processed gas which were fractionated and purified in the same manner as in the SRC area. The liquid product from the flash stages was flashed again to separate a stream boiling nominally above 500° F. from a stream boiling below 500° F. The 500° F.− stream was collected as product, and the 500° F.+ stream was recycled to the first stage to be used as process solvent. The process conditions for the example are presented in Table V and the yield structure is given in Table VI.

TABLE V

| Process Conditions for Wilsonville Run 242 | |
|---|---|
| Material Balance 242A - 12/10/82 | |
| SRC Unit | |
| Coal (MF):first stage distillate solvent: Hydrocracker flash bottoms ratio | 1:0:0.0:2.0 |
| Slurry concentration, wt. % MF coal | 36.4 |
| Feed gas, scfh | 3,650 |
| Hydrogen purity, mol % | 90.1 |
| Reactor coal space, rate, lb/hr-ft$^3$ | 38.5 |
| Reactor pressure, psig | 2,410 |
| Hydrogen partial pressure, inlet psia | 2,150 |
| Reactor temperature, outlet °F. | 859 |
| HTR Unit | |

TABLE V-continued

| Process Conditions for Wilsonville Run 242 | |
|---|---|
| Feed slurry concentration, wt. % SRC | 50.1 |
| Space velocity (lb feed/hr) lb cat | 1.08 |
| Recycle gas rate, MSCF/ton SRC | 62.6 |
| Hydrogen purity, mol % | 95.9 |
| Hydrogen partial pressure, inlet psia | 2,721 |
| Temperature, °F. | 680 |

TABLE VI

| Yield Structure for Wilsonville Run 242 | |
|---|---|
| Material Balance 242A - 12/10/82 | |
| Yields, wt. % MAF Coal | |
| Hydrogen consumption | (3.85) |
| Total gases | |
| $C_1/C_5$ | 4.72 |
| $H_2S$ | 2.11 |
| $CO_x$ | 1.20 |
| $NH_3$ | 0.76 |
| $H_2O$ | 8.22 |
| Net Usable Product | |
| ibp–350° F. | 5.85 |
| 350°–450° F. | 5.70 |
| 450° F.–EP | 43.38 |
| HTR SRC | 9.60 |
| Ash Concentrate | |
| 450° F.–EP | 0.72 |
| SRC | 8.36 |
| Unconverted coal | 13.22 |
| Total | 100.01 |

We claim:

1. A process for solvent refining coal with increased distillate production by recycle of hydrotreated asphaltenes that are pentane insoluble, benzene soluble and heavy preasphaltenes that are benzene insoluble, pyridine soluble in the absence of ash, unconverted coal and very heavy preasphaltenes that are pyridine insoluble which comprises forming a first stage slurry of finely divided coal, hydrogenated process solvent recycle hereinafter more specifically defined and hydrogen-rich gas, heating said slurry, passing said heated slurry to a dissolver vessel, dissolving at least a portion of said coal within said dissolver vessel, adding fresh hydrogen to form a liquified coal slurry, passing said liquified coal slurry to a vapor-liquid separator, separating a vapor product stream and a condensed liquid product stream, passing said condensed liquid product stream to a first stage distillation system to form a residual bottoms product and a hydrocracker solvent stream, removing said residual bottoms product to a critical solvent deashing zone, wherein said residual bottoms product is mixed with a deashing solvent to form a deashing stage slurry, passing said deashing stage slurry into a deashing separator to form deashing separator effluents consisting essentially of:

(i) a light upper phase containing asphaltenes that are pentane insoluble, benzene soluble;

(ii) a heavy lower phase containing preasphaltenes that are benzene insoluble, pyridine soluble; and (iii) a very heavy lower phase containing unconverted coal, ash concentrates and very heavy preasphaltenes that are pyridine insoluble;

separating stream (iii) from the combination of streams (i) and (ii), passing said very heavy lower phase of stream (iii) to a gasification unit to generate hydrogen, mixing said light upper phase of stream (i) with said heavy lower phase of stream (ii) and passing said admixture with said hydrocracker solvent derived from said first distillation zone in combination therewith through a hydrocracker zone having a hydrocracker catalyst therein subject to deactivation, said hydrocracker zone being operated at a temperature of at least 700° F. (371° C.) and a pressure of at least 1500 psig (10375 kPa) to produce a hydrocracker effluent stream, passing said hydrocracker effluent stream to a hydrocracker flash unit to produce two streams, the first hydrocracker flash effluent stream containing 500° F.+ asphaltenes and preasphaltenes in the absence of ash, unconverted coal and very heavy preasphaltenes and the second stream containing 500° F.− as distillate product of said process, wherein substantially all of said first hydrocracker flash effluent stream containing said asphaltenes and preasphaltenes is passed as process solvent to slurry said coal and hydrogen to produce a greater quantity of distillates from said coal.

2. The process of claim 1, wherein the hydrocracker is operated so as to provide a conversion efficiency of 850 F.+ (454° C.+) material to 850° F.− material of at least 20%.

3. The process of claim 1, wherein said hydrocracker is an ebullated bed reactor.

4. The process of claim 1, wherein the superficial residence time of said first stage slurry in said dissolver is greater than 40 minutes.

5. The process of claim 1, wherein said coal is a low iron coal containing less than 1 wt% iron.

6. The process of claim 1 wherein said hydrocracker solvent derived from said first distillation zone comprises at least 50% of hydrocracker feed.

7. The process of claim 1, wherein the ratio of said hydrocracker flash bottoms to process solvent to MF coal in said first stage slurry is 2:0:1 to 0.2:1.5:1.0.

* * * * *